US005345953A

United States Patent [19]

Taylor

[11] Patent Number: 5,345,953

[45] Date of Patent: Sep. 13, 1994

[54] CIGARETTE SNUFFER

[75] Inventor: Joe E. Taylor, Troy, Mich.

[73] Assignee: Cigarette Saver, Inc., Troy, Mich.

[21] Appl. No.: 144,781

[22] Filed: Oct. 29, 1993

[51] Int. Cl.[5] ..... A24F 13/18

[52] U.S. Cl. ..... 131/256

[58] Field of Search ..... 131/256, 235.1, 231, 131/329; 401/82, 63, 132; 15/427, 429, 435, 436; 206/496

[56] References Cited

U.S. PATENT DOCUMENTS

| | | | |
|---|---|---|---|
| 2,002,494 | 5/1935 | Eisenberg | 131/256 X |
| 2,120,027 | 6/1938 | Johnson . | |
| 2,240,538 | 5/1941 | Adams | 131/256 X |
| 2,371,445 | 3/1945 | Irvin . | |
| 2,609,820 | 9/1952 | Vakilian | 131/256 X |
| 2,715,961 | 8/1955 | Field . | |
| 3,107,674 | 10/1963 | Smith | 131/256 |
| 3,978,981 | 9/1976 | Musick . | |
| 4,587,980 | 5/1986 | Tipper . | |
| 4,809,715 | 3/1989 | Musetti . | |
| 5,002,073 | 3/1991 | Chiang . | |

FOREIGN PATENT DOCUMENTS 2749624 5/1979 Fed. Rep. of Germany ... 131/235.1

*Primary Examiner*—Jennifer Bahr
*Attorney, Agent, or Firm*—Brooks & Kushman

[57] ABSTRACT

A cigarette snuffer for extinguishing a lit cigarette is made of a cylindrical thin-wall tube having an open end section and a closed end section, with two diametrically opposed slots in the tube wall extending between the closed end section and open end section for enabling a user to grasp and remove an extinguished cigarette disposed in the tube. The slots have a sufficient width along the circumference of the tube such that a portion of the cigarette placed therein extends beyond the internal tube wall at opposite sides of the tube. The slots are spaced at least about one inch or one-fourth to one-third the length of the tube from the closed end of the tube.

6 Claims, 1 Drawing Sheet

CIGARETTE SNUFFER

TECHNICAL FIELD

This invention is directly related to devices for extinguishing and storing for later use cigarettes, cigars, and the like, and is particularly directed to a cigarette snuffer.

BACKGROUND ART

Devices for extinguishing cigarettes and cigars and related rolled tobacco products have been known for a long time. Typical examples are seen in U.S. Pat. Nos. 2,120,027; 2,371,445; 2,715,961; 3,978,981; 4,587,980; 4,809,715; and 5,002,073. Common amongst these prior art devices is the objective of providing a simple and inexpensive means by which the cigarette may be rapidly extinguished and stored, and then later relit and used by the smoker until the tobacco product is fully used. The need for such a snuffing device is particularly acute today in light of the increased health consciousness of the public, and the resultant statutory prohibition against smoking in many public places, as well as in private industry. Thus, the time available to the smoker to enjoy a cigarette at any one sitting has become very limited in certain locations and work situations.

SUMMARY OF THE INVENTION

It is therefore an object of the present invention to provide a particularly aesthetically attractive, inexpensive, effective, easily usable and storable cigarette snuffing device.

It is a further object of the present invention to provide a cigarette snuffer as described above which may be carried or stored in the conventional cigarette package of 20 cigarettes, or in a cigarette carrying case or similar device wherein the cigarette snuffer will fit as easily as the cigarettes as it will have basically the same length and overall shape and size as the cigarette.

Further, it is an object of the present invention to provide a cigarette snuffer of the type described above which has no moving parts and is constructed as a simple tube closed at one end and internally sized relative to the cigarette being extinguished such that the cigarette is quickly extinguished upon being inserted within the tube, and further including a pair of opposed slots in the side wall of the tube of sufficient length and geometry such that enough of the cigarette projects within the slots to allow the user to grasp the cigarette and slidably remove the cigarette from the snuffer, and wherein the length of the slot is such that any cigarette ranging in length from a new cigarette to one which has been almost completely used will be exposed to the slot and allow grasping of the cigarette by the smoker.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
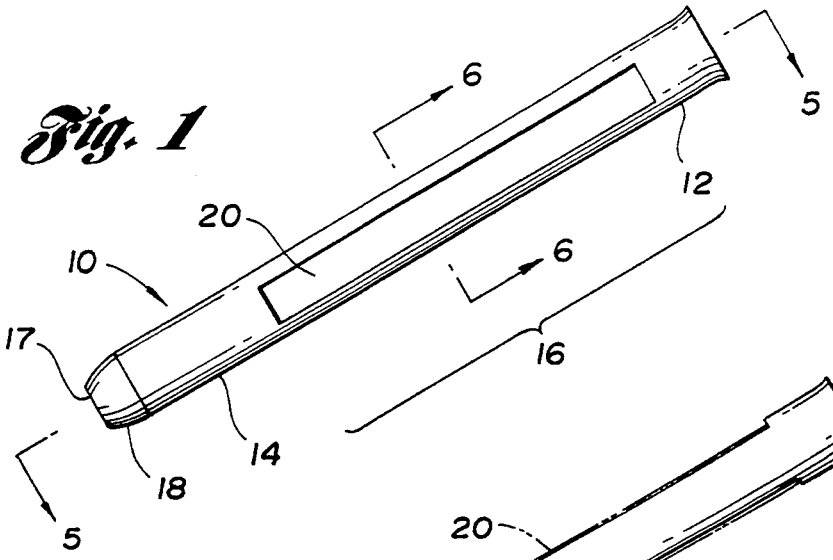
FIG. 1 is a side view of the cigarette snuffer in accordance with the present invention from both sides as the view is the same from either side.

Looking at the drawings, it will be noted that the cigarette snuffer generally designated 10 is in the form of an elongated tube open at one end section 12 and closed at the opposite end section 14 and including an intermediate barrel section 16. The tube 10 may be made of plastic or a soft metal, such as aluminum or copper, bronze or brass or mild steel. If of plastic, the tube may be injection molded with no finishing operations being required. If made from tube stock, the closed end of the tube may be spun closed and the slots described below may be milled, and finishing operations will be limited to deburring, a bright dip and anodizing for a clear finish or color. In any case, it is desired the tube be thin-walled, in the order of 0.018 inches to 0.036 inches, and no more than 0.050 inches. The inner diameter is approximately equal to, but slightly greater than, an ordinary cigarette so that the cigarette can be slid into and out of the tube easily, and yet maintain a sufficient partial seal with the tube such that the oxygen in the air cannot get to the lit tip of the cigarette quickly enough to allow ignition to continue once the cigarette is dropped into the tube.

Preferably, the open end 12 of the tube is flared to allow the cigarette to be easily centered relative to the tube prior to inserting it within the tube. A 30° flare is very satisfactory with just the top ⅛ inch being flared.

At the closed end section 14, it will be noted the front end or nose of the tube is bullet-shaped or cone-shaped with the nose 17 being flat and having a diameter equalling about one-half that of sections 12, 14 and 16. The transitional portion 18 includes an internal radius R in the order of 0.160 inches to provide a generally hemispherical tip with the cylindrical walls of the tube converging toward the tip and thereby providing an inner constriction upon which the lit end of the cigarette will become impinged. This action assures the tip of the lit cigarette will quickly be starved for oxygen and therefore extinguished. It will be noted that even throughout the nose section of the tube, the tube includes a uniform wall section thickness.

Figure 2:
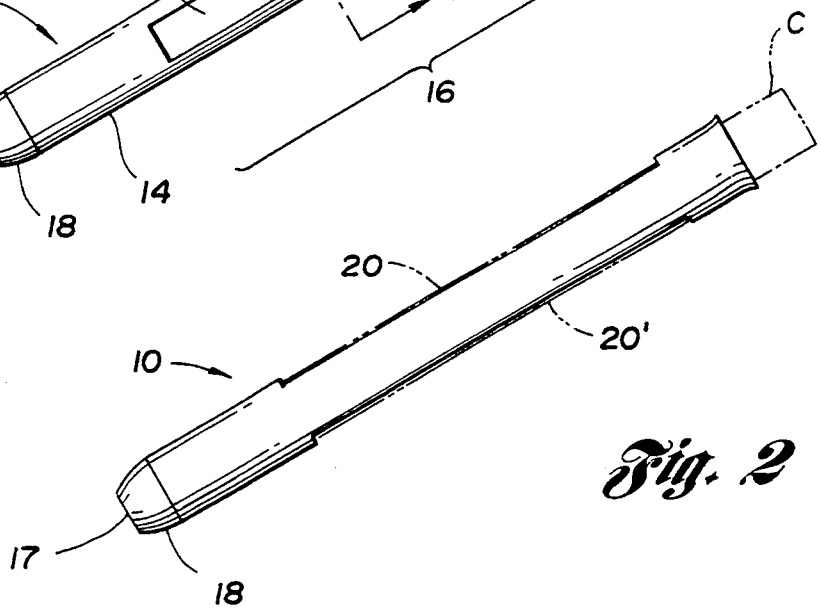
FIG. 2 is both a top view and a bottom view of the cigarette snuffer in accordance with the present invention, as the view is the same from the top and the bottom, showing the cigarette snuffer rotated 90° about its longitudinal axis from the position shown in FIG. 1.
Figure 3:
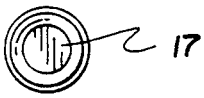
FIG. 3 is an end view from the closed end of the cigarette snuffer.
Figure 4:
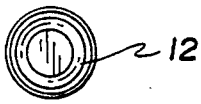
FIG. 4 is an end view from the open end of the cigarette snuffer of the present invention.

Cigarette withdrawal slots 20,20' are disposed diametrically opposite one another and are of equal width and length and constructed in the same manner such that the view from one side is identical to the view from the other side. A filter tip standard length cigarette C is shown in FIG. 2 in dotted line as inserted fully within the snuffer 10.

Figure 5:
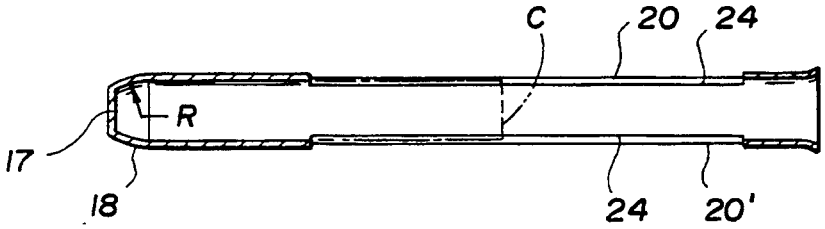
FIG. 5 is a cross-sectional view taken along the lines 5—5 of FIG. 1.
Figure 6:
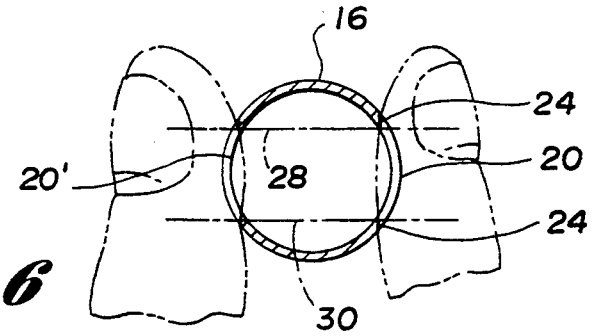
FIG. 6 is a cross-sectional view taken along the lines 6—6 of FIG. 1, as well as illustrating an alternative manner of cutting the slot along the side walls as shown in dashed line.

The length of the slots 20,20' are sufficient to allow extraction of even the shortest reusable cigarette C stub, as indicated in dotted line in FIG. 5, allowing the user to finger grasp the cigarette by its sides (as shown in FIG. 6) and slide it through the tube and beyond the open end 12 sufficiently to locate the cigarette stub between the user's lips. Preferably, the slots 20 will extend from very near the opened end 12 to the bottom $\frac{1}{3}$ to $\frac{1}{4}$ of the tube. Preferably, the tube 10 will be 4 inches long with the slot running $2\frac{1}{4}$ inches in length beginning 1 inch from nose 17.

The width of the slots 20,20' is preferably maintained to a minimum such that just enough of the cigarette will protrude through the slots to allow the user to grasp the cigarette, and yet the remaining solid wall portions of the intermediate section will be of sufficient width to preclude the possibility of any lighted cigarette ash falling from the cigarette tip as it is inserted in the tube. I have found that with a tube having a thin wall section of approximately 0.027 inches, and given a standard diameter cigarette of approximately 0.300 inches, the slot width is best maintained at approximately 0.188 inches. This will represent approximately 30% of the circumference of the tube being open across the slots 20,20'. It is preferred the slots be machined or otherwise formed in the tube to provide the slot walls 24 of each respective slot 20,20' lying within a common plane, as shown in FIG. 6. This is a particularly desirable construction with the more thicker walled tubes since it allows a larger portion of the cigarette to project from the slot and thereby it is more easily grasped by the user. Alternatively, each of the slots might be cut from the tube by passing from slot 20 to slot 20' in the several planes 28,30, as shown in dotted line in FIG. 6.

If the tube is to be made from plastic, a polystyrene plastic is preferred as it offers a substantial amount of heat resistance as well as good heat insulating properties and high impact resistance. However, regardless of the material used for the tube, the effectiveness of the snuffer in extinguishing the cigarette is so good that the cigarette is immediately extinguished and therefore no heat passes through the device to the user.

While the best mode for carrying out the invention has been described in detail, those familiar with the art to which this invention relates will recognize various alternative designs and embodiments for practicing the invention as defined by the following claims.

What is claimed is:

1. In combination with a cigarette having a predetermined diameter and length, a cigarette snuffer for extinguishing the cigarette and storing it for later use by the smoker, said cigarette snuffer comprising:

a cylindrical thin wall tube having an open end section for receiving a cigarette ignited end first, and a closed end section within which the ignited end of the cigarette will be received when fully inserted, and an intermediate section between said end sections, the closed end section extending at least about one inch along the length of the tube;

said tube having a length approximately that of the cigarette;

said tube having a uniform internal diameter throughout the length thereof from said closed end section to said open end section nearly equal to the predetermined diameter of the cigarette received therewithin, whereby the cigarette may be self-retained within the tube by slight frictional engagement with the internal wall of the tube; and said tube being fully enclosed intermediate said end sections excepting a pair of opposed slots within the tube wall extending substantially the length of said intermediate section and at least one-half the total length of said tube;

said slots being of sufficient width relative to the wall thickness and tube outer diameter through the length of said slots, such that a portion of the cigarette will project beyond the internal tube wall at opposite sides of the tube to facilitate its removal by the smoker, and the remainder of said tube about its circumference and intermediate said slots constituting the major circumferential portion of said tube.

2. The invention as defined in claim 1 wherein said tube is a plastic tube.

3. The invention as defined in claim 2 wherein said plastic tube is of polystyrene material.

4. A cigarette snuffer for extinguishing a cigarette and storing it for later use by the smoker, comprising:

a cylindrical thin wall tube of approximately 0.025 inch wall thickness having an open end section for receiving a cigarette ignited end first, and a closed end section having a closed end within which the ignited end of the cigarette will be received when fully inserted, and an intermediate section between said end sections;

said tube having a uniform internal diameter throughout the length thereof from said closed end section to said open end section equal to approximately 0.300 inches and thereby adapted to retain any cigarette received therewithin by slight frictional engagement with the internal wall of the tube; and said tube including a pair of opposed slots of identical geometry within the tube wall extending approximately one-half the total length of the tube beginning approximately 1 inch from said closed end;

said slots being of a width comprising about 30% of the total circumference of said tube, whereby a portion of the cigarette will project beyond the internal tube wall at opposite sides of the tube to facilitate its removal by the smoker.

5. The invention as defined in claim 4 wherein said tube is a plastic tube.

6. The invention as defined in claim 5 wherein said plastic tube is of polystyrene material.

* * * * *